US008532524B2

(12) United States Patent
Souda

(10) Patent No.: US 8,532,524 B2
(45) Date of Patent: Sep. 10, 2013

(54) IMAGE FORMATION DEVICE HAVING FIRST FRAME FOR SUPPORTING IMAGE FORMATION UNIT AND SECOND FRAME OF LOWER FLEXURE RIGIDITY

(75) Inventor: Makoto Souda, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 301 days.

(21) Appl. No.: 13/074,392

(22) Filed: Mar. 29, 2011

(65) Prior Publication Data

US 2011/0262173 A1 Oct. 27, 2011

(30) Foreign Application Priority Data

Apr. 27, 2010 (JP) ..... 2010-102164

(51) Int. Cl.
*G03G 15/00* (2006.01)

(52) U.S. Cl.
USPC ..... 399/107; 399/89; 399/90; 399/110

(58) Field of Classification Search
USPC ..... 399/88, 89, 90, 107, 110, 27, 111
See application file for complete search history.

(56) References Cited

U.S. PATENT DOCUMENTS

| | | | | |
|---|---|---|---|---|
| 7,664,425 | B2 | 2/2010 | Tsusaka | |
| 7,894,743 | B2 | 2/2011 | Tomatsu | |
| 7,937,019 | B2 | 5/2011 | Tsusaka et al. | |
| 8,401,418 | B2 * | 3/2013 | Souda | 399/90 |
| 2006/0034633 | A1 | 2/2006 | Tsusaka et al. | |
| 2006/0140659 | A1 * | 6/2006 | Washio et al. | 399/89 |
| 2008/0002341 | A1 | 1/2008 | Tomatsu | |
| 2010/0014887 | A1 | 1/2010 | Tomatsu et al. | |
| 2010/0098451 | A1 | 4/2010 | Tsusaka et al. | |
| 2011/0129250 | A1 | 6/2011 | Kondo | |

FOREIGN PATENT DOCUMENTS

| | | | |
|---|---|---|---|
| JP | HEI02-024585 | U | 2/1990 |
| JP | 08-202236 | | 8/1996 |
| JP | 08-224937 | | 9/1996 |
| JP | 11-249362 | A | 9/1999 |
| JP | 2001-166550 | | 6/2001 |
| JP | 2006-053255 | A | 2/2006 |
| JP | 2006-243749 | | 9/2006 |
| JP | 2008-009262 | A | 1/2008 |
| JP | 2008-090122 | A | 4/2008 |
| JP | 2010-044363 | | 2/2010 |
| JP | 2011-112943 | A | 6/2011 |

OTHER PUBLICATIONS

JP Reasons for Rejection dated Apr. 3, 2012; corresponding Application No. 2010-102164.

* cited by examiner

*Primary Examiner* — Sophia S Chen
(74) *Attorney, Agent, or Firm* — Banner & Witcoff, Ltd.

(57) ABSTRACT

An image formation device is provided with an image formation unit configured to form an image on a recording sheet, a first frame arranged to support the image formation unit, a second frame connected to the first frame, flexure rigidity of the second frame being smaller than flexure rigidity of the first frame, an electric substrate electrically connected with the image formation unit. With the above configuration, the electric substrate is arranged to extend from the first frame to the second frame and is secured onto the first frame with the position on the first frame being adjusted.

17 Claims, 10 Drawing Sheets

IMAGE FORMATION DEVICE HAVING FIRST FRAME FOR SUPPORTING IMAGE FORMATION UNIT AND SECOND FRAME OF LOWER FLEXURE RIGIDITY

CROSS-REFERENCE TO RELATED APPLICATION

This application claims priority under 35 U.S.C. §119 from Japanese Patent Application No. 2010-102164 filed on Apr. 27, 2010. The entire subject matter of the application is incorporated herein by reference.

BACKGROUND

1. Technical Field

Aspects of the present invention relate to an image formation device having a frame which is composed of a plurality of members having different deflection rigidities.

2. Related Art

There has been known an image formation device of which a frame is composed of metal members and resin members. Typically, an electric substrate supplying electric power to an image formation unit is secured to a pair of frames, the frames being arranged to sandwich (straddle) the image formation unit.

SUMMARY

If the frame is composed of the metal members and the resin members, flexural deformation of the electric substrate may be relatively large. The metal member and the resin member generally have different flexural rigidities. Therefore, even if the same force is applied to the metal member and the resin member, the resin member may deform largely. Therefore, if the electric substrate is arranged to sandwich (straddle) a metal member and a resin member and fixed thereto, due to difference of the flexural deformation of the resin member and the metal member, flexural deformation of the electric substrate may be caused.

Aspects of the invention is advantageous in that, the flexural deformation of an electric substrate is suppressed when the electric substrate is arranged to straddle a plurality of member having different flexural rigidities and fixed thereto.

According to aspects of the invention, there is provided an image formation device, which is provided with an image formation unit configured to form an image on a recording sheet, a first frame arranged to support the image formation unit, a second frame connected to the first frame, flexure rigidity of the second frame being smaller than flexure rigidity of the first frame, an electric substrate electrically connected with the image formation unit. The electric substrate is arranged to extend from the first frame to the second frame and is secured onto the first frame.

According to aspects of the invention, there is also provided an image formation device, which is provided with an image formation unit including a photoconductive drum bearing developer, a charger configured to charge the photoconductive drum, a main frame arranged to support the image formation unit, the image formation unit being secured to the main frame, an electric substrate secured to the pair of main frame, the electric substrate providing electric power to the charger, a light emitter and a light receiver provided on the electric substrate, the light emitter emitting a light beam to a predetermined portion of the image formation unit, the light receiver receiving light beam emitted from the image formation unit, and an optical element provided on the electric substrate and arranged on an optical axis of one of the light emitter and the light receiver.

BRIEF DESCRIPTION OF THE ACCOMPANYING DRAWINGS

FIG. 1 schematically shows a cross sectional view of an image formation device according to an embodiment of the invention.

DETAILED DESCRIPTION

Figure 1:
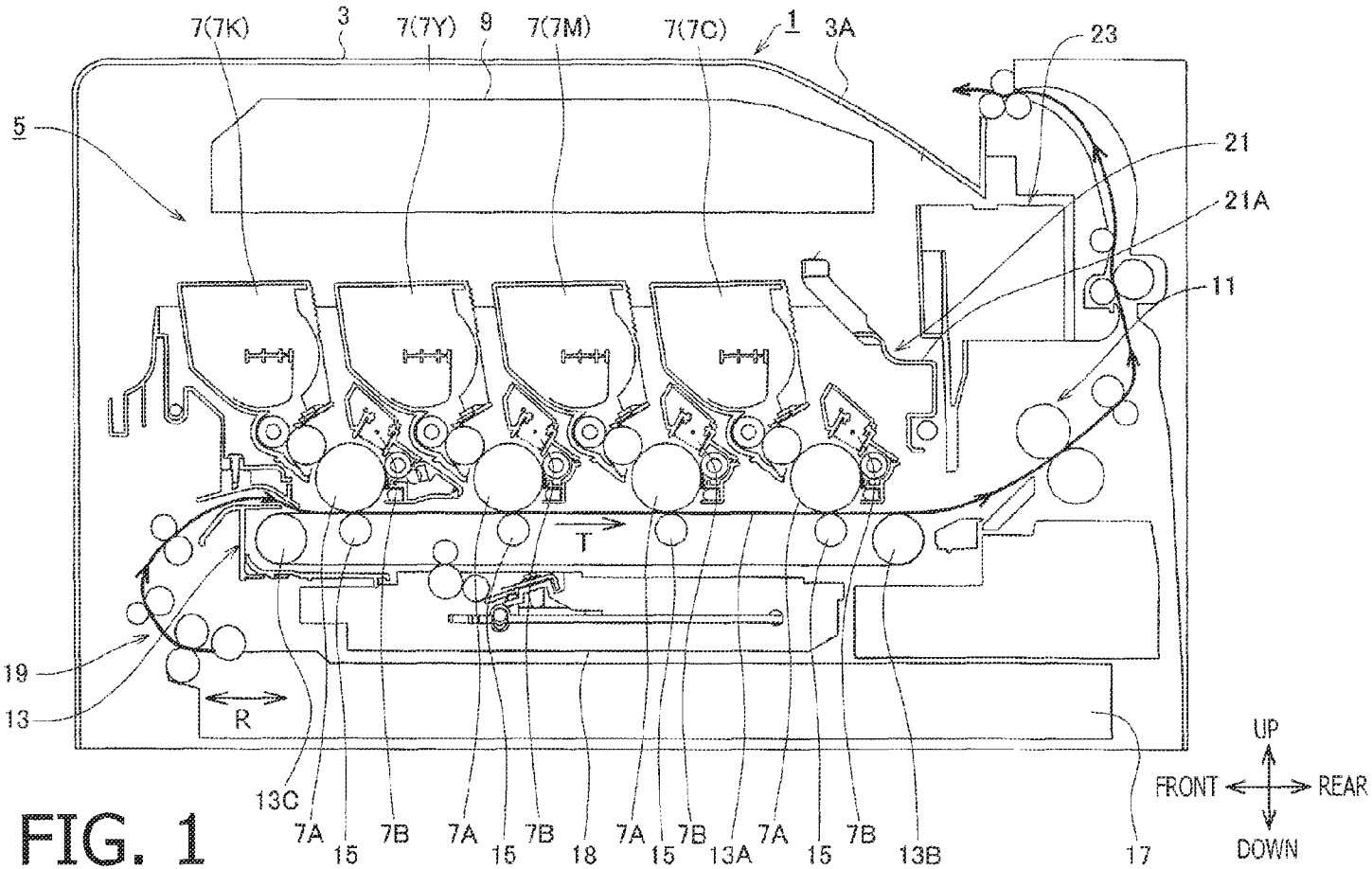

Hereinafter, an exemplary embodiment according to aspects of the present invention will be described with reference to the accompany drawings.

In a housing 3 of an image formation device 1, an image formation unit 5, which forms images on sheets such as printing sheets, OHP sheets and the like (hereinafter, referred to as recording sheets or sheets) in accordance with an electrophotographic imaging method, is accommodated. The image formation unit 5 includes a process unit 7, an exposure unit 9, a fixing unit and the like.

The image formation device 1 according to the embodiment is a so-called tandem type device, which has a plurality of process units 7 which are arranged in a sheet feed direction T. According to the embodiment, four process units 7 are employed. Specifically, the four process units 7 includes a process unit 7K accommodating black developer, a process unit 7Y accommodating yellow developer, a process unit 7M accommodating magenta developer, and a process unit 7C accommodating cyan developer.

The four process units 7 have substantially the same structure and only the colors of the developer are different. Each process unit 7 (i.e., each of the process units 7K, 7Y, 7M and 7C) includes a photoconductive drum 7A and a charger 7B that charges a circumferential surface of the photoconductive drum 7A.

The charged circumferential surface of the photoconductive drum 7A is exposed to light emitted by the exposure unit 9 to form an electrostatic latent image on the circumferential surface of the photoconductive drum 7. Then, by supplying charged developer to the photoconductive drum 7A, the developer is selectively adhered on the circumferential surface of the photoconductive drum 7A (an image is developed).

At a position facing the photoconductive drum 7A, a transfer roller 15 is provided with the transfer belt 13A being located therebetween. The transfer roller 15 is used for transferring the developer (i.e., developed image) on the circumferential surface of the photoconductive drum 7A to the recording sheet. To the transfer roller 15, a predetermined voltage, necessary for transferring the developer from the photoconductive drum 7A to the recording sheet, is applied.

According to the embodiment, the plurality of photoconductive drums 7A are arranged along the sheet feed direction T with their axes being aligned perpendicular to the sheet feed direction T. The plurality of photoconductive drums 7A are secured to a drawer casing 21A. The developed images carried by the plurality of photoconductive drums 7A are transferred on the recording sheet with being overlapped as the recording sheet is fed by the transfer belt 13A.

After the developed images carried by the photoconductive drums 7A have been transferred, the recording sheet is further fed to the fixing unit 11, at which the developed image is heated and fused, and fixed onto the recording sheet. Thereafter, the recording sheet is fed upward along the sheet feed path, discharged from the housing 3 and stacked on a sheet discharge tray 3A defined on an upper surface of the housing 3.

The transfer belt 13A is an endless belt which is wound around a driving roller 13B and a driven roller 13C. As the driving roller 13B rotates, the transfer belt 13A moves and the driven roller 13C is driven by the transfer belt 13A to rotate. The transfer belt 13A, the driving roller 13B, the driven roller 13C and a frame supporting the above constitute a belt unit 13.

Below the belt unit 13, a sheet feed tray 17 is provided. The recording sheets to be fed toward the image formation unit 5 (or transfer belt 13A) are stacked on the sheet feed tray 17. The sheets stacked on the sheet feed tray 17 are fed one by one toward the image formation unit by a feeder mechanism 19. The sheet feed tray 17 is movable, in the direction parallel with a surface of a first electric substrate 29 (i.e., front-and-rear direction R in the embodiment). The sheet feed tray 17 is detachably attached to the main body.

According to the embodiment, the process units 7K, 7Y, 7M and 7C are assembled in a drawer casing 21A, thereby defined is a drawer unit 21. The drawer unit 21 is also movable in a direction parallel with the surface of the first electric substrate 29 (in the embodiment, the front-and-rear direction R) and is detachably inserted in the main body. With this configuration, the four process units 7K, 7Y, 7M and 7C can be inserted into/removed from the main body, integrally.

In this specification, the main body means a pair of main frames 23 and the like, which will not be disassembled or removed in normal use. Incidentally, the frames 23 are plate-like members and arranged on both sides, in the width direction, with the image formation unit 5 (i.e., a drawer unit 21) being located therebetween. The width direction means a direction which is perpendicular to the sheet feed direction T and thickness direction. According to the embodiment, the width direction is equal to the right-and-left direction of the image formation device 1. The plate plane of the first electric substrate 29 is a virtual plane of the first electric substrate 29, which coincides with a vertical surface according to the embodiment. It should be noted that the main body may be a single frame (not a pair of frames) and the image formation unit may be supported by the single frame.

Incidentally, according to the embodiment, an accommodating unit accommodating developer and a cartridge unit 7E provided with a pair of developing rollers that applies the developer to the photoconductive drum 7A is removably attached to the process unit 7 (or the drawer casing 21A). Therefore, simply by exchanging the cartridge units 7E, the developer can be supplied.

Each of the main frames 23 has a first frame 25 made of iron alloy such as SPCC and a second frame 27 made of resin such as ABS resin. The second frame 27 is arranged below the first frame 25, and they are mechanically fastened at a plurality of positions (three, in the embodiment) with, for example, screws.

According to the embodiment, the Young's modulus E of the material of the second frame 27 is smaller than that of the first frame 25. Therefore, the flexure rigidity of the second frame 27 is smaller than that of the first frame 25, and a cross-sectional second order moment I of the second frame 27 is greater than a predetermined value so that the flexure rigidity (E·I) of the second frame 27 does not become excessively small.

The predetermined value (the cross-sectional second order moment I of the second frame 27) should be designed appropriately based on load acting on the second frame 27, necessary rigidity and the like. An optimum value thereof should be determined based on try and error. Incidentally, the Young's modulus of the ABS resin is 1.5 GPa-7.1 GPa, and that of SPCC is 203 GPa.

The right-side and left-side second frames 27 are formed with recessed portions 27A, respectively. The recessed portions 27A are formed such that a space defined between the pair of main frames 23, that is, the space accommodating the image formation unit 5 (i.e., the drawer unit 21) is narrowed by the recessed portions 27A. The cross-sectional shape of each second frame 27 in the width direction is approximately U-shaped.

Figure 3:
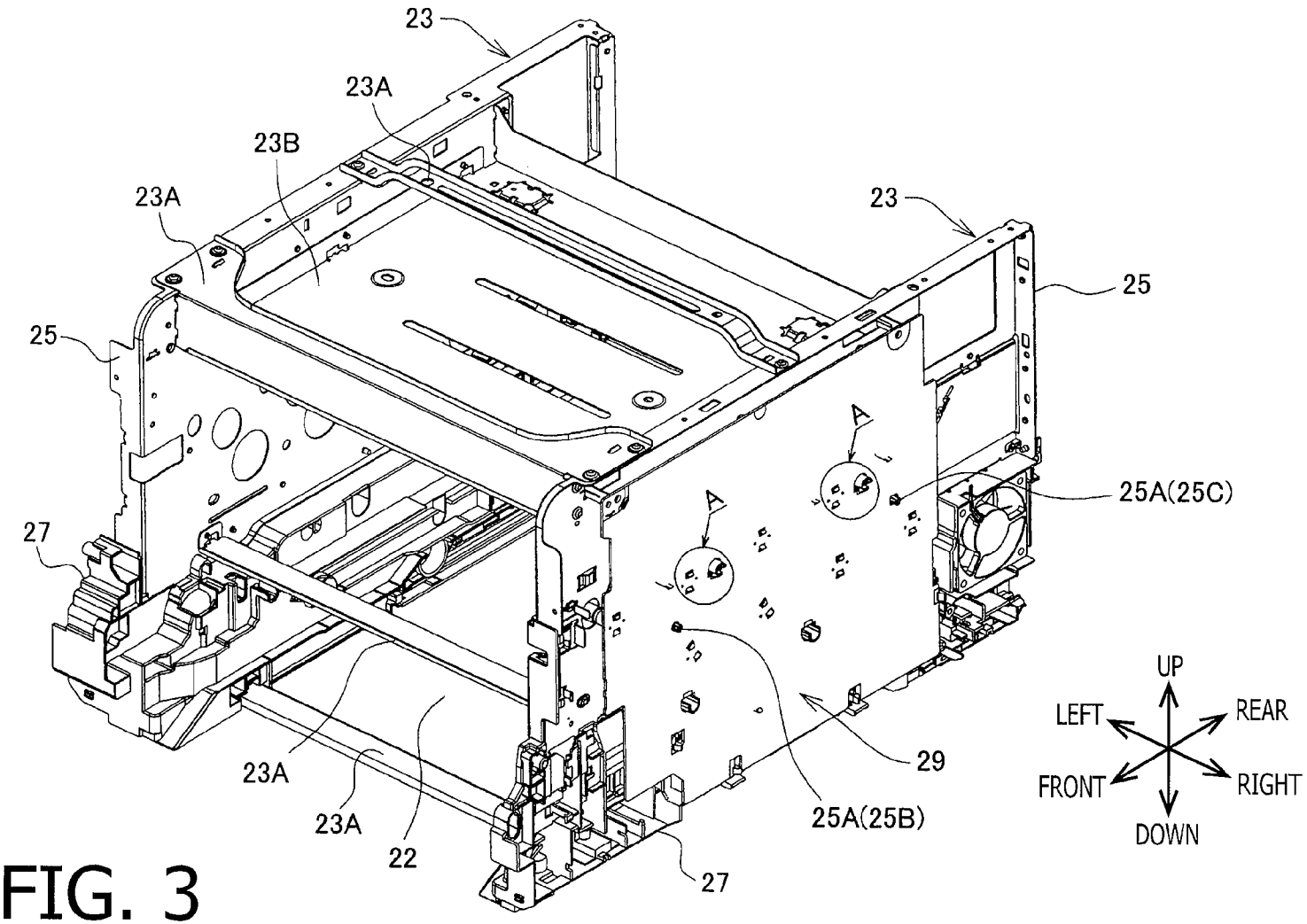
FIG. 3 is a perspective view of a main frame of the image formation device shown in FIG. 1 with an electric substrate being attached.

The main frames 23 (the right-side and left-side main frames 23) are connected with each other, as shown in FIG. 3, with beam-like bridge frames 23A and a top plate 23B to form a so-called Rahmen structure frame. It should be noted that the bridge frames 23A and the top plate 23B are made of metal (e.g., SPCC) and the top plate 23B also serves as a support plate which supports the exposure unit 9.

On the right-side main frame 23, the first electric substrate 29 is secured. The first electric substrate 29 is a plate-like substrate supplying electricity to the image formation unit 5 (i.e., the photoconductive drums 7A, chargers 7B and transfer rollers 15, etc.). On the left-side main frame 23, a second electric substrate which supplies electricity to an electric motor (not shown) is secured (see FIG. 3).

In the following description, unless specified, the "main frame 23" means the right-side main frame 23 and the electric substrate 29 means the first electric substrate 29 secured to the right-side main frame.

Figure 7:
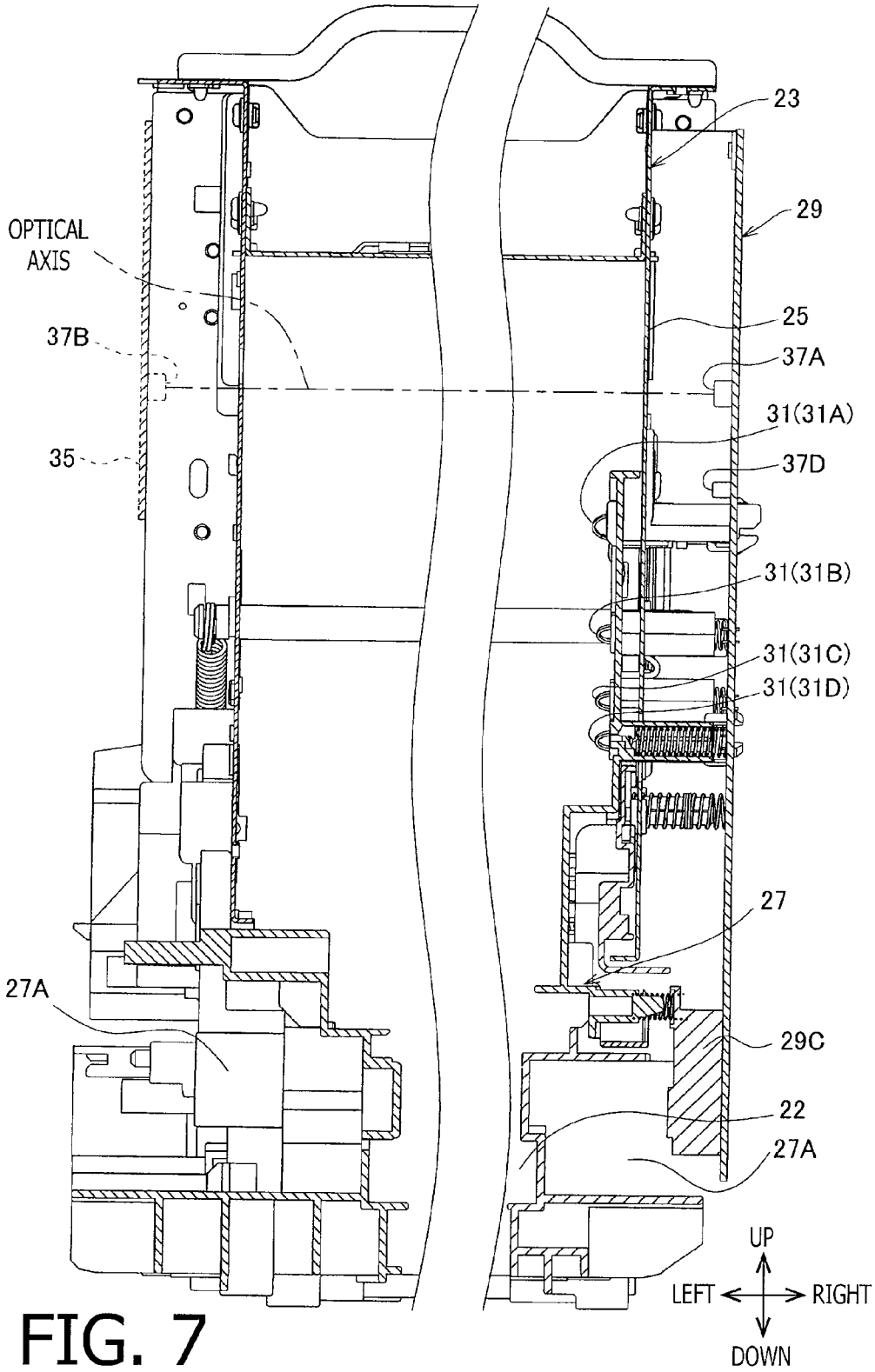
FIG. 7 is a cross sectional view of the main frame taken along line A'-A' in FIG. 6, according to the embodiment of the invention.

The electric substrate 29 is secured to the first frame 25, with its position being adjusted with respect to the first frame 25, on the side opposite to the accommodating space 22, such that the electric substrate 29 extends over the first frame 25 and the second frame 27. A relatively large electric component 29C attached to the electric substrate 29 is arranged on the second frame 27 side (i.e., the main frame 23 side) as shown in FIG. 7.

Figure 2:
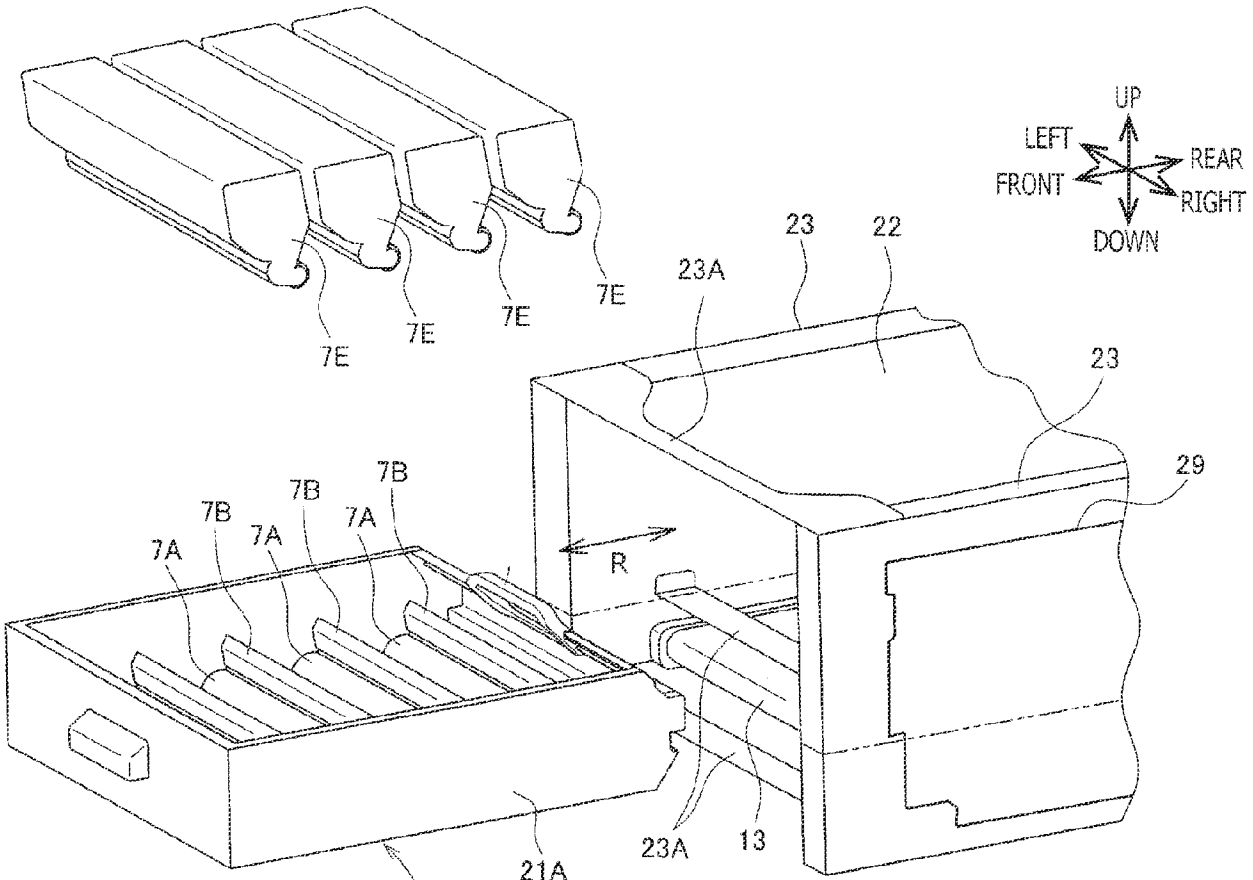
FIG. 2 is a perspective view showing removal/insertion of a drawer unit of the image formation device shown in FIG. 1.

The main frame 23 (in particular, the first frame 25) has a plate-like shape and arranged to be substantially parallel with the vertical direction as shown in FIG. 2. The first electric substrate 29 and the second electric substrate 35 are arranged such that their planar surfaces are parallel with the main frames 23 (the first frames 25) as shown in FIG. 7.

Figure 4:
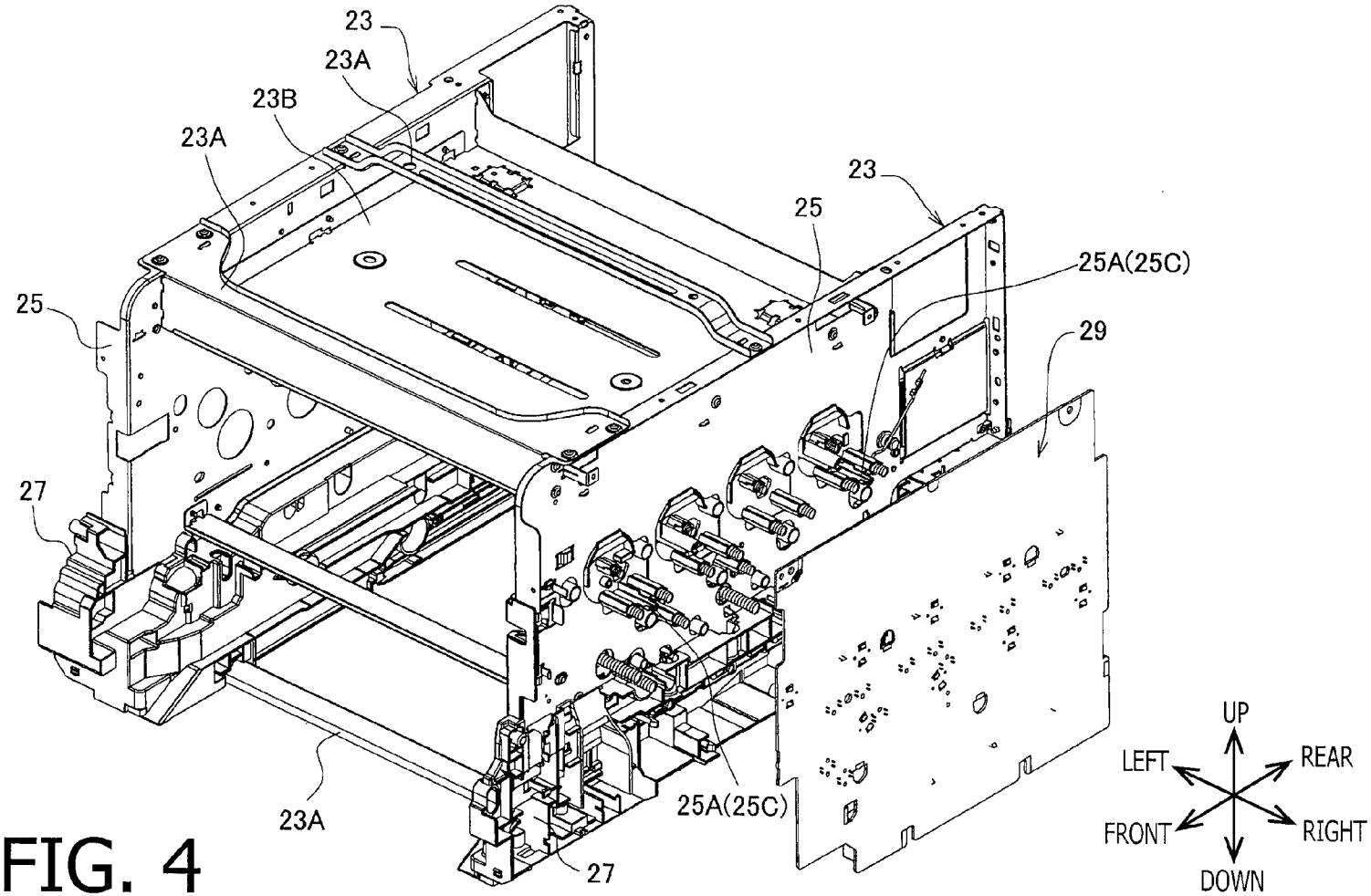
FIG. 4 is a perspective view of the main frame of the image formation device shown in FIG. 1 with an electric substrate being detached.
Figure 5:
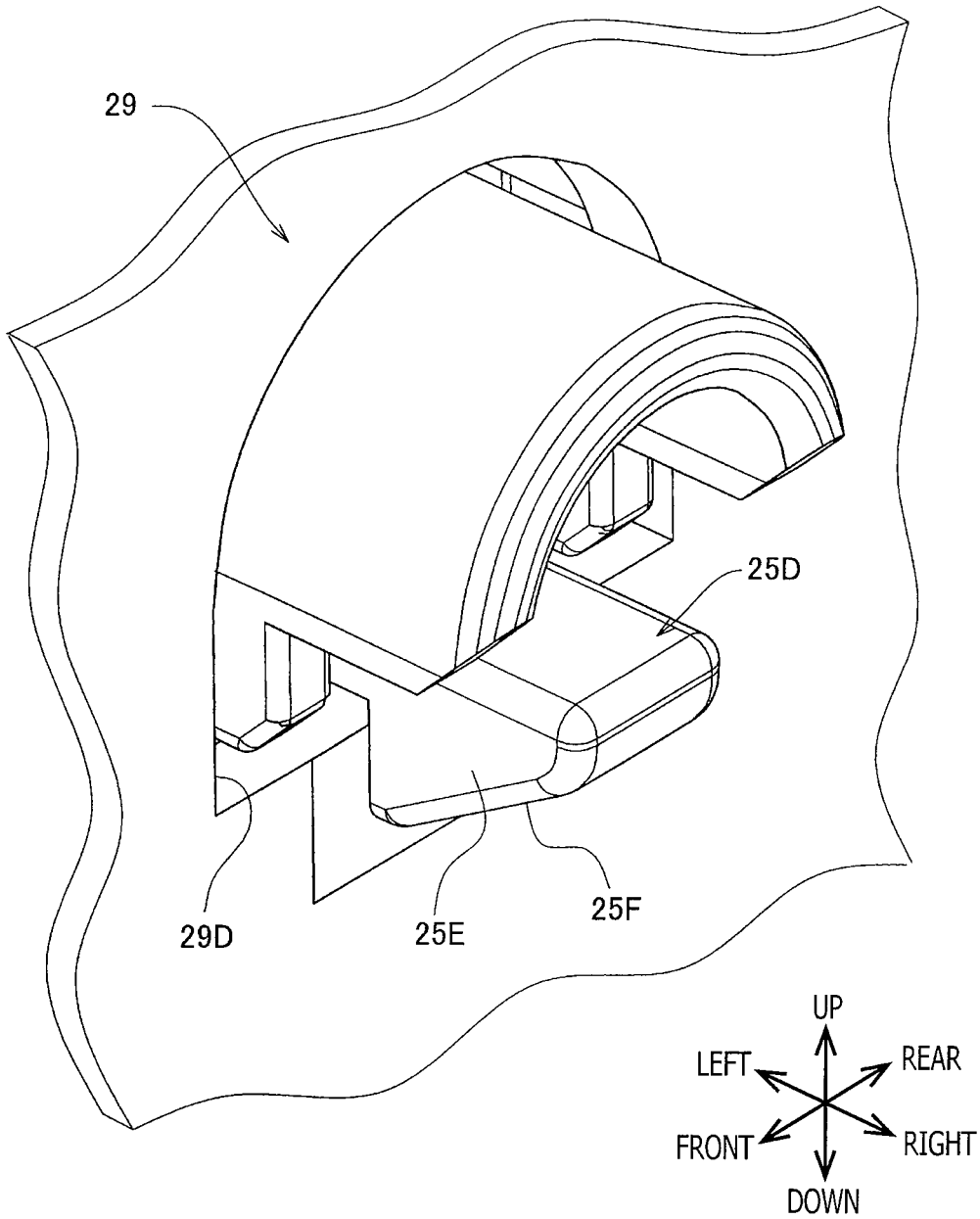
FIG. 5 is an enlarged perspective view of a holding hook according to the embodiment of the invention.
Figure 6:
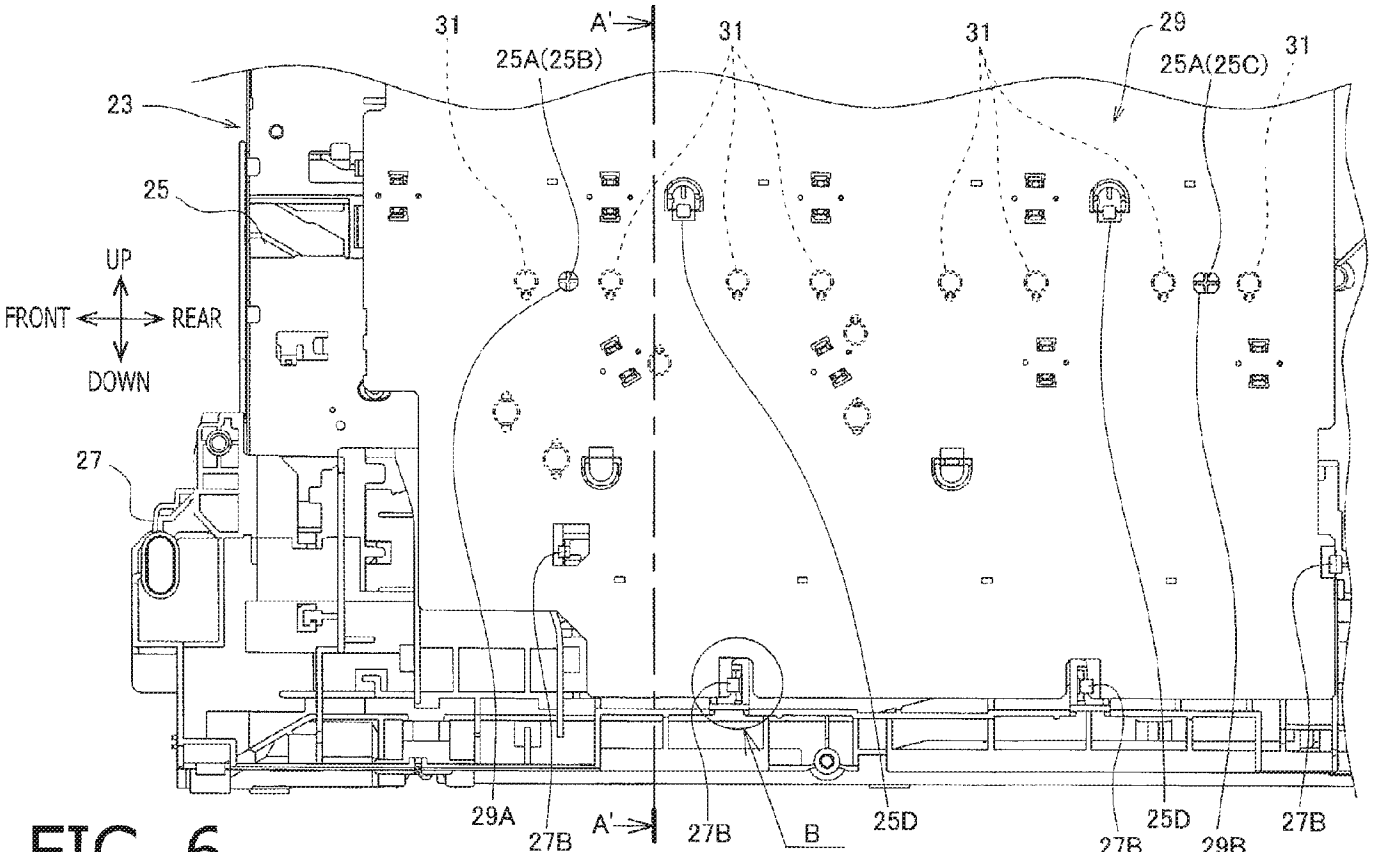
FIG. 6 is a front view of the main frame with the electric substrate being attached according to the embodiment of the invention.

The first frame 25 is provided with positioning protrusions 25A (see FIG. 4) which protrude from the first frame 25 toward the electric substrate 29 and are used for adjusting the position of the electric substrate 29 with respect to the first frame, and holding hooks 25D which hold the electric substrate 29 so as to prevent the electric substrate 29, of which position is adjusted with the positioning protrusions 25A, from displacing in the width direction (see FIGS. 5 and 6).

The positioning protrusions 25A include an origin positioning protrusion 25B, and a rotation regulating protrusion 25C. The positioning protrusions 25A are aligned in an insertion/removal direction of the drawer unit 21 (i.e., in the front-and-rear direction R of the image formation device 1 in the embodiment) with spaced by a predetermined interval (see FIG. 6).

The origin positioning protrusion 25B is used for adjusting an origin, or a reference position defined on the electric substrate 29 (which is a hole 29A of the electric substrate 29 in which the origin positioning protrusion 25B is to be inserted) with a frame securing origin point (which is a point where the origin positioning protrusion 25B is provided) defined on the first frame 25.

The rotation regulating protrusion 25C is inserted in a hole 29B formed on the electric substrate 29 and regulates rotation of the electric substrate 29 about the frame securing origin point (i.e., the origin positioning protrusion 25B in the embodiment).

The origin positioning protrusion 25B and the rotation regulating protrusion 25C are made of resin (PC/ABS resin according to the embodiment) and fixed to the first frame 25. Each of the origin positioning protrusion 25B and the rotation regulating protrusion 25C has a crisscross cross-section taken along a plane perpendicular to protruding direction thereof.

The hole 29A in which the origin positioning protrusion 25B is inserted is formed to have a perfect-circular cross section, while the hole 29B in which the rotation regulating protrusion 25C is inserted is formed to have an oval cross section of which a longer diameter extends in a direction connecting the hole 29A and the hole 29B.

The positioning protrusions 25A and the holes 29A and 29B are arranged (designed) such that the origin positioning protrusion 25B and the rotation regulating protrusion 25C slightly deform when they are inserted in the holes 29A and 29B, respectively, in order to prevent play of the electric substrate 29 with respect to the first frame 25.

Figure 8:
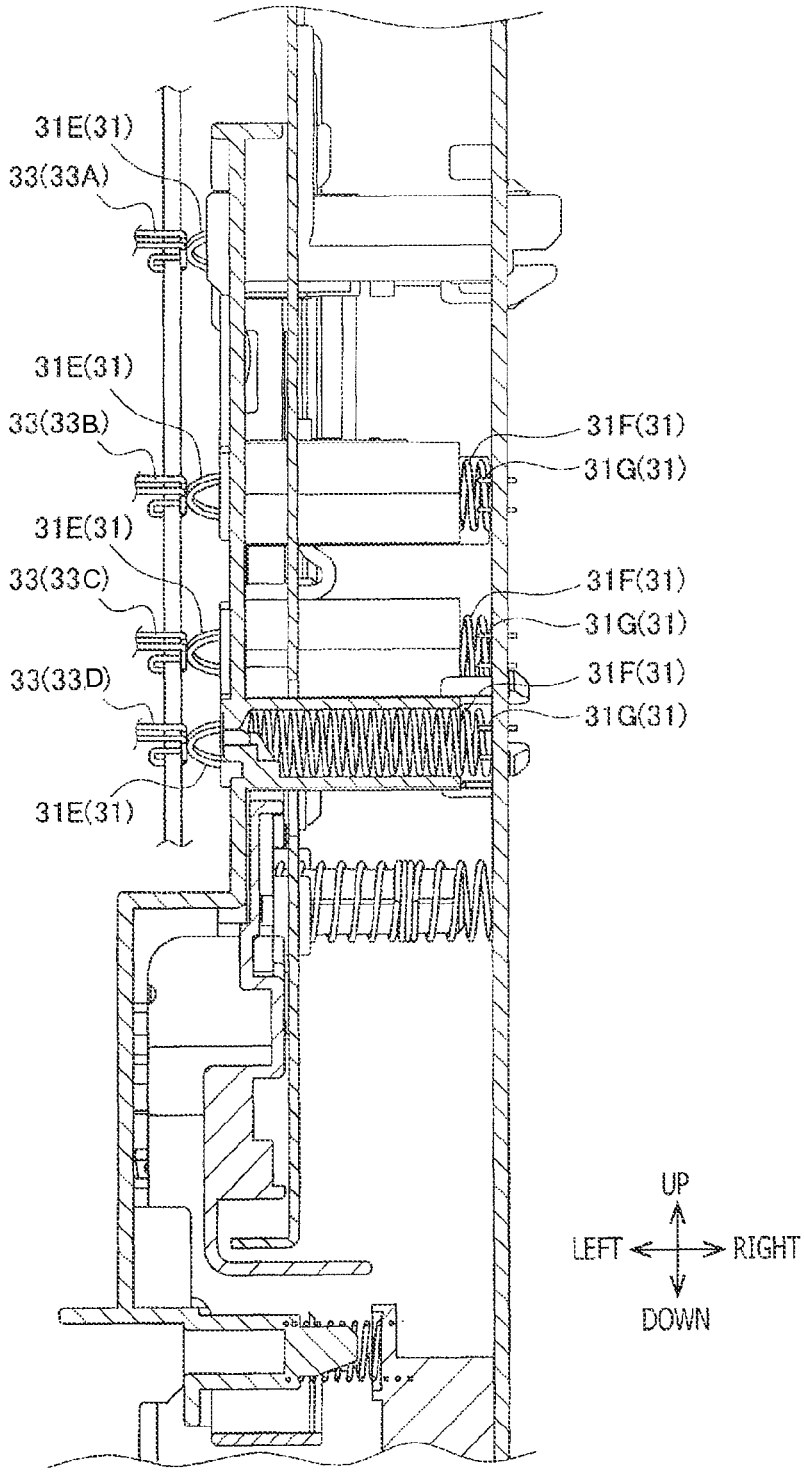
FIG. 8 is an enlarged cross sectional view of the right-hand side main frame shown in FIG. 7.

On the electric substrate 29 side, substrate electrodes 31A-31D (which will also be referred to collectively as substrate side electrodes 31) which protrude from a wall surface of the main frame 23 towards the accommodating space 22 (i.e., image formation unit 5) as shown in FIG. 7. The substrate side electrodes 31 contact image formation device side electrodes 33A-33D (which will also be referred to collectively as device side electrodes 33) as shown in FIG. 8.

According to the embodiment, the electric substrate 29 and the image formation unit 5 are electrically connected each other via the substrate side electrodes 31 and the device side electrodes 33, electric power is supplied to the image formation unit 5. At least one of the plurality of (six, in the embodiment) substrate side electrodes 31 is located between the origin positioning protrusion 25B and the rotation regulating protrusion 25C, as shown in FIG. 6.

Incidentally, the substrate side electrodes 31 include a spring 31F which is a coil spring, a ring-shaped contact 31E which is secured to a longitudinal end side of the spring 31F and contacts the device side electrodes 33, and a terminal 31G which is provided to the electric substrate 29 and contacts the other longitudinal end of the spring 31F. The spring 31F and the contact 31E are integrated.

Incidentally, according to the embodiment, the spring 31F is held by the first frame 25 via a resin member secured to the first frame 25. The resin member holding the spring 31F and the resin member to which the positioning protrusion 25A are integrated (see FIG. 4).

The device side electrodes 33 are held by a frame of the drawer casing 21 and the belt unit 13, and the device side electrodes 33A-33D are provided on supply electric power to the process unit 7 etc.

According to the embodiment, by elastically deforming the spring 31F to compress, a contacting pressure between the contact 31E and the device side electrode 33, and a contacting pressure between the terminal 31G and the spring 31F are increased so that an electric connection between the electric substrate 29 and the image formation device 5 is ensured.

With the above configuration, when the electric substrate 29 is installed on the main frame 23, the electric substrate 29 always receives a force which separates the electric substrate 29 from the main frame 23 (hereinafter, this force will be referred to as a separating force), in the embodiment, holding hooks 25D and 27B (see FIG. 6) are provided to countervail the separating force.

The holding hooks 25D are received at a plurality of portions (two, in the embodiment) along a line extending in a direction parallel to a direction where the plurality of positioning protrusions 25A (25B and 25C) are arranged with a predetermined interval therebetween. The holding hooks 25D are, as shown in FIG. 5, engaging protrusions which fit in the engaging holes 29D formed on the electric substrate 29.

The holding hooks 25D are beam-like protrusions which protrude from the first frame 25 toward the electric substrate 29 (toward right side, in the embodiment), and configured to be elastically deformable at least in the up-and-down direction. A tip (right end in the embodiment) of each protrusion is formed with a hook-like engaging portion 25E which engages with the engaging hole 29D. Incidentally, the holding hooks 25D are integrally formed on the resin which is formed with the positioning protrusion 25A.

The engaging portion 25E is formed with a taper surface 25F so that the cross section taken along a plane perpendicular to the protruding direction is smaller on the tip side. Therefore, when the electric substrate 29 is secured onto the first frame 25 (main frame 23), the taper surface 25F and an edge of the engaging hole 29D contact each other, and the holding hook 25D elastically deforms.

When the edge of the engaging hole 29 passes over the taper surface 25F and reaches an elementary part (proximal end) of the holding hook 25D, the engaging hole 29D and the engaging portion 25E engage with each other, and the electric substrate 29 is held, against the separating force.

Incidentally, the holding hook 25D is configured such that the electric substrate 29 is allowed to deform in a direction opposite to the positioning direction or a direction of the separating force, but that deformation of the electric substrate 29 in a upward direction is basically prohibited.

Figure 9A:
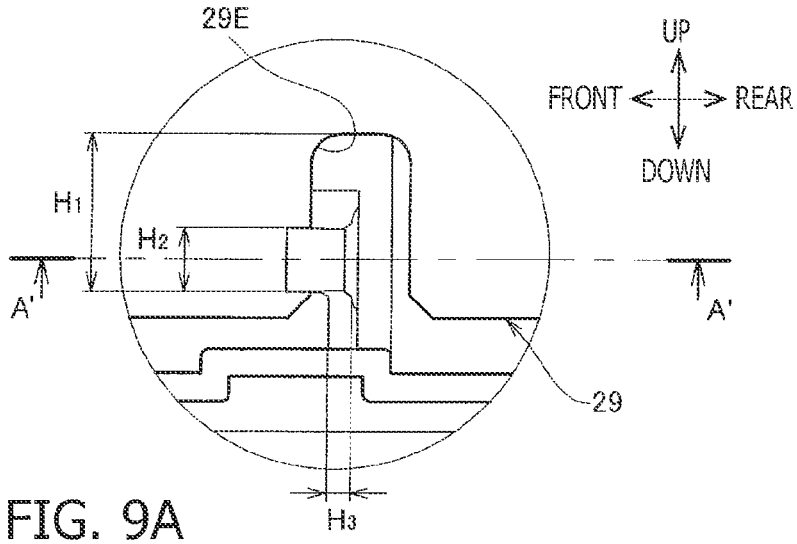
FIG. 9A is an enlarged view of a circled portion B in FIG. 6.
Figure 9B:
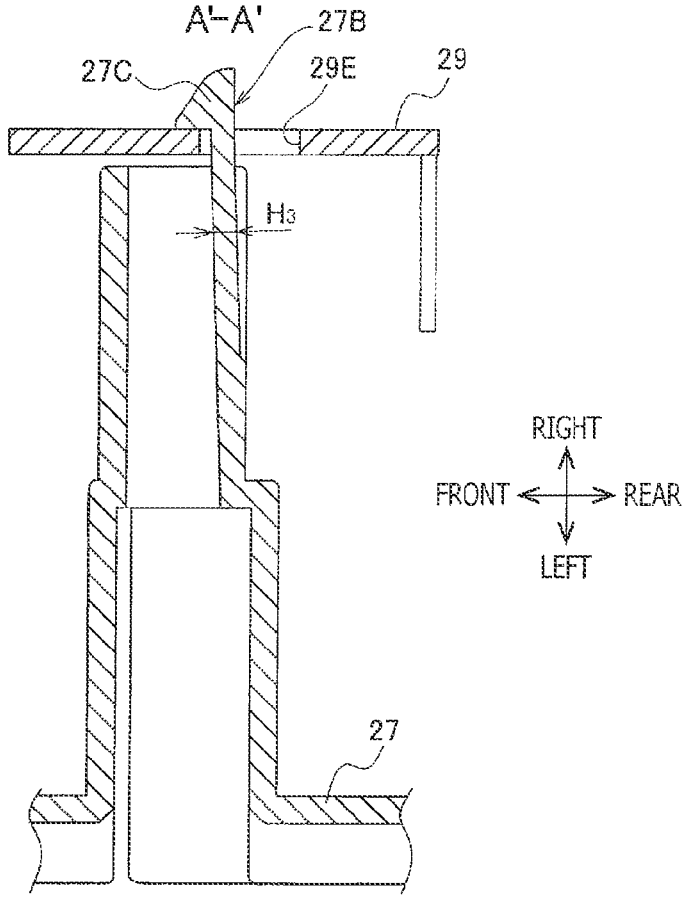
FIG. 9B is a cross sectional view of the circled portion B taken along line A'-A' in FIG. 9A.
Figure 10:
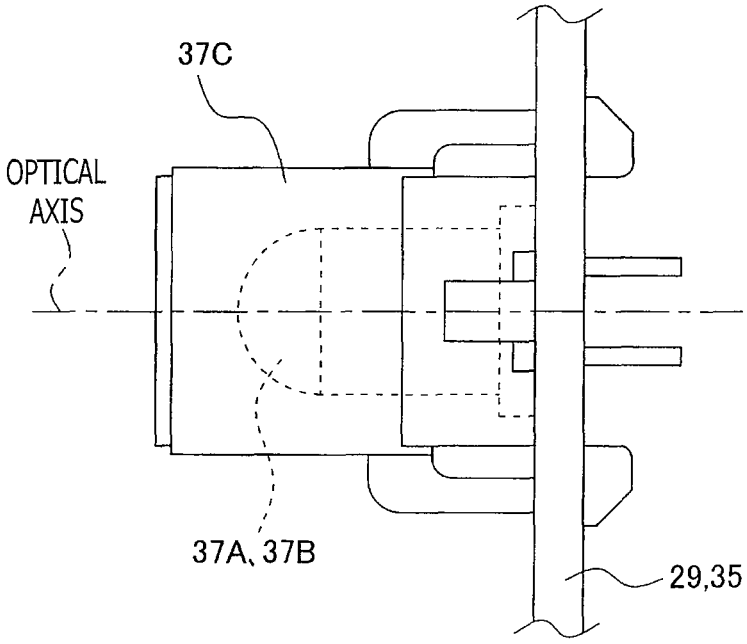
FIG. 10 shows a plan view of the light emitting unit, light receiving unit and lens as assembled.

The holding hook 27B is an engaging protrusion to fit in engaging hole 29E as shown in FIG. 9A. The holding hook 27B is a beam-like member which protrudes from the second frame 27 toward the electric substrate 29, and is at least elastically deformable in the positioning direction.

At the tip of the holding hook 27B, similarly to the holding hook 25D, a hook-shaped engaging portion 27C which engages with an edge of an engaging hole 29E is formed. Therefore, similarly to the holding hook 25D, the edge of the engaging hole 29E and the engaging portion 27C engage and the electric substrate 29 is held against the separating force. Incidentally, according to the embodiment, the holding hook 27B is integrally formed on the second frame 27.

A size H1, in the up-and-down direction, of the engaging hole 29E is, as shown in FIG. 9A, greater than a size H2, in the up-and-down direction, of the holding hook 27B. Therefore, the holding hook 27B allows the electric substrate 29 to move in the up-and-down direction or a direction opposite to the direction of the separating force, but basically restricts a displacement of the electric substrate 29 in the positioning direction. The holding hook 27B is configured to have a rectangular shape such that the size H2 thereof in the up-and-down direction is greater than a horizontal size H3, that is, the size in a direction perpendicular to the protruding direction of the holding hook 27B.

In order to detect the amount of the developer accommodated in a cartridge 7E of the process unit 7, a light emitter 37A configured to emit light beam toward a predetermined portion defined on the image formation unit 5, and a light receiver 37B which receives the light emitted by the light emitter 37A and passed through the image formation unit 5 are provided.

Specifically, a plurality of light emitters 37A are arranged along the sheet feed direction T to face the cartridges 7E, respectively, and emit light beams, in the width direction, toward the respective cartridges 7E. Similarly, a plurality of light receivers 37B are provided to receive the light beams emitted by the light emitters 37A and passed through the cartridges 7E, respectively.

If a sufficient amount of developer is contained in the cartridge 7E, the light beams emitted by the light emitters 37A are shielded by the developer and the light receivers 37B do not receive the light beams. If the developer contained in the cartridge 7E is reduced, the light receivers 37B receive the light beams. Therefore, based on the light beams received by the light receivers 37B, the remaining amount of the developer can be judged.

On an optical axis of the light emitter 37A, a lens 37C is arranged. Similarly, on an optical axis of the light receiver 27B, a lens 37C is arranged. The lenses 37C are respectively fixed to the electric substrate 29 and 35.

At a portion of the electric substrate corresponding to the photoconductive drums 7A, a plurality of light emitters 37D (see FIG. 7) for discharging the circumferential surfaces of the photoconductive drums 7A are arranged. The plurality of light emitters 37D are arranged along the sheet feed direction T and face the respective photoconductive drums 7A.

According to the embodiment, the electric substrate 29 is arranged in the main frame 23 such that it extends over the first frame 25 and the second frame 27. Specifically, the electric substrate 29 is positioned with respect to the first frame 25 and secured thereto. Since the first frame 25 has higher flexure rigidity than the second frame 27, even if the second frame 27 is deformed by a relatively large amount, effect of the deformation of the second frame 27 on the first frame 25 can be well suppressed, and the flexure deformation of the electric substrate 29 can be suppressed According to the embodiment, the second frame 27 is made of resin, and arranged below the first frame 27. With this structure, if the image formation device 1 is placed on a distorted plane and the flexure deformation of the second frame 27 occurs to absorb the distortion, relatively large flexure deformation of the electric substrate 29 can be suppressed.

On one of the second frame 27 and the electric substrate 29 (the second frame 27 in the embodiment), the holding hook 27B that engages with the engaging hole 29E formed on the other of the second frame 27 and the electric substrate 29 (the electric substrate 29 in the embodiment) is provided. Further, the size H1 of the engaging hole 29 in the up-and-down direction is greater than the size H2 of the holding hook 27B in the up-and-down direction.

Therefore, according to the embodiment, the second frame side portion of the electric substrate 29 is prevented from exhibiting a play to move toward/away from the second frame 27. Further, relative displacement of the second frame 27 with respect to the electric substrate 29 in the up-and-down direction due to the flexure deformation of the second frame 27 can be absorbed.

Further, according to the embodiment, the size H2 of the holding hook 27B in the up-and-down direction is greater than the size H3 of the holding hook 27B in the horizontal direction (i.e., a direction perpendicular to its protruding direction). With this configuration, the holding hook 27B and the engaging hole 29E engage within a relatively large range in the up-and-down direction. Therefore, the holding hook 27B can move in the up-and-down direction relative to the engaging hole 29E, while relative displacement of the second frame 27 with respect to the electric substrate 29 due to the flexure deformation of the second frame 27 can be absorbed, and the electric substrate 29 can be held.

On at least one of the electric substrate 29 and the image formation unit 5 (the electric substrate 29 in the embodiment), the substrate side electrode 31 that protrudes toward and contacts the image formation side electrode 33 provided to the other of the electric substrate 29 and the image formation unit 5 (the image formation unit 5 in the embodiment) is provided. Thus, the electric substrate 29 and the image formation unit 5 are electrically connected via the electrodes 31 and 33. Therefore, the electric substrate 29 and the image formation unit 5 should be positioned accurately.

According to the embodiment, since the position of the electric substrate 29 is adjusted with respect to the first frame 25, which has high flexure rigidity, and secured thereto, it is possible that the electric substrate 29 and the image formation unit 5 are accurately positioned.

Further, according to the embodiment, the electric substrate 29 is formed with the light emitters 37A emitting light beams toward predetermined portions defined on the image formation unit 5, and the light receivers 27B receiving the light beams passed through the image formation unit 5. Since the electric substrate 29 and the image formation unit 5 can be positioned accurately, the above-described feature functions appropriately.

Further, according to the embodiment, the positioning protrusions 25A include the origin positioning protrusion 25B for adjusting the origin of the electric substrate 29 to the frame side origin of the first frame 25, and the rotation regulating protrusion 25C for regulating the rotation of the electric substrate 29 about the frame side origin.

On at least one of the electric substrate 29 and the image formation unit 5 (the electric substrate 29 in the embodiment), the substrate side electrode 31 that protrudes toward and contacts the image formation side electrode 33 provided to the other of the electric substrate 29 and the image formation unit 5 (the image formation unit 5 in the embodiment) is provided. Further, the substrate side electrode 31 is located between the origin positioning protrusion 25B and the rotation regulating protrusion 25C.

With the above structure, the positional accuracy in assembling components is the highest between the origin positioning protrusion 25B and the rotation regulating protrusion 25C. According to the embodiment, the substrate side electrode 31 is located in the area where the accuracy is the highest, it is ensured that the electrode 31 and 33 contact each other.

According to the embodiment, the recessed portion 27A is formed on the second frame 27. The recessed portion 27A is recessed in the direction opposite to the accommodating space 22 in which the image formation unit 5 is provided, with respect to the second frame 27. Further, the electric substrate 29 is arranged on the side opposite to the accommodating space 22 with the second frame 27 therebetween, and the electrical component 29C is provided on the second frame side of the electric substrate 29.

With the above structure, by designing the electric component 29C to fit in the recessed portion 27A, the recessed portion can by effectively used and downsizing of the image formation device 1 can be achieved.

According to the embodiment, the sheet feed tray 17 and the drawer unit 21 (or drawer casing 21A) are installed in the main body as units movable in a horizontal direction (i.e., in the direction parallel with a plane of the electric substrate 29). Therefore, if the electric substrate 29 is attached to the main frame such that it extends over the first frame 25 and the second frame 27, the electric substrate 29 does not obstacle the movement of the sheet feed tray 17 or the drawer unit 21.

Thus, freedom in designing the image formation device 1 can be obtained without losing the operability in moving the sheet feed tray 17 or the drawer unit 21.

In the above-described embodiment, the first frame 25 is made of iron-type metal, and the second frame 27 is made of ABS resin. However, the invention needs not be limited to such a configuration. It should be noted that various modifications of the embodiment can be made without departing from the scope of the invention.

For example, in the exemplary embodiment, the first frame 25 is arranged above the second frame 27. This structure can be changed such that the first frame 25 is arranged below the second frame 27, or the first frame 25 and the second frame 27 are arranged at different positions on the same horizontal plane.

In the exemplary embodiment, the holding hooks 25D and 27B are provided to the main frame 23 (the first frame 25 and the second frame 27), and the engaging holes 29D and 29E are formed on the electric substrate 29. However, the invention needs not be limited to such a configuration, and the engaging holes 29D and 29E may be formed on the main frame 23 and the holding hooks 25D and 27B may be provided to the electric substrate 29.

In the exemplary embodiment, the size H2 in the up-and-down direction of the holding hook 27B is greater than the size H3 in the horizontal direction. However, the invention needs not be limited to this configuration, and can be modified such that, for example, the size H2 is equal to or less than the size H3.

In the exemplary embodiment, the size H1, in the up-and-down direction, of the engaging hole 29E is greater than the size H2, in the up-and-down direction, of the holding hook 27B. The invention needs not be limited to this configuration, and can be modified such that, for example, the size H1 is equal to or less than the size H2.

In the exemplary embodiment, the positioning protrusions 25A are to fit in the holes 29A and 29B formed on the electric substrate 29. Such a configuration can be modified such that the holes 29A and 29B are formed on the first frame 25 and the protrusion 25A is provided to the electric substrate 29.

According to the embodiment, the image formation device is of the direct type which directly transfers the developer on the recording sheet fed on the transfer belt 13A. The invention needs not be limited to this configuration, and can be modified. For example, the image formation device may be of the indirect type which once transfer the developer onto the transfer belt, and then transfer the developer on the transfer belt onto the recording sheet. The image formation device may be an inkjet printer.

What is claimed is:

1. An image formation device, comprising:

an image formation unit configured to form an image on a recording sheet;

a first frame extending in a first direction and configured to support the image formation unit;

a second frame connected to the first frame, flexure rigidity of the second frame being smaller than flexure rigidity of the first frame; and an electric substrate electrically connected with the image formation unit, wherein the electric substrate has a plate-like shape with a generally planar surface extending parallel to the first direction, wherein the electric substrate extends over the first frame and the second frame and is secured onto the first frame.

2. The image formation device according to claim 1, wherein the second frame is made of resin of which Young's modulus is smaller than that of material of the first frame, and wherein the second frame is arranged below the first frame.

3. The image formation device according to claim 2, wherein, on one of the second frame and the electric substrate, an engaging protrusion that is to engage with an engaging hole formed on the other of the second frame and the electric substrate is formed, and wherein a size of the engage hole in an up-and-down direction is greater than a size of the engaging protrusion in the up-and-down direction.

4. The image formation device according to claim 3, wherein a size of the engaging protrusion in an up-and-down direction is greater than a size of the engaging protrusion in a horizontal direction which intersects with a protruding direction of the engaging protrusion.

5. The image formation device according to claim 2, wherein the first frame is provided with:

a positioning structure which is used to adjust a position of the electric substrate with respect to the first frame; and a holding structure which holds the electric substrate of which position is adjusted with use of the positioning structure.

6. The image formation device according to claim 5, wherein the positioning structure includes:

an origin positioning structure configured to adjust an origin position of the electric substrate with a frame side origin position defined on the first frame; and a rotation regulating structure configured to regulate rotation of the electric substrate about the frame side origin position, wherein at least one of the electric substrate and the image formation unit is provided with an electrode protruding toward another electrode provided to the other of the electric substrate and the image formation unit, and wherein the electrode provided to the electric substrate is located between the origin positioning structure and the rotation regulating structure.

7. The image formation device according to claim 2, wherein at least one of the electric substrate and the image formation unit is provided with an electrode which protrudes to contact an electrode provided to the other of the electric substrate and the image formation unit, and wherein the electric substrate and the image formation unit are electrically connected through the electrodes provided to the electric substrate and the image formation unit.

8. The image formation device according to claim 2, wherein the electric substrate is provided with one of (1) a light emitter configured to emit a light beam to a predetermined portion of the image formation unit and (2) a light receiver configured to receive a light beam emitted from the image formation unit.

9. The image formation device according to claim 2, wherein the second frame is formed with a recessed portion which is recessed from a side opposite to a space where the image formation unit is accommodated toward the space with respect to the second frame, wherein the electric substrate is arranged on a side opposite to the space with respect to the second frame, and wherein an electric component is provided on a second frame side surface of the electric substrate.

10. The image formation device according to claim 1, wherein the image formation unit includes a plurality of photoconductive drums which are arranged in a direction perpendicular to axes of the plurality of photoconductive drums.

11. The image formation device according to claim 1, wherein the first frame is made of iron-type metal having Young's modulus larger than material of the second frame, and wherein the first frame is arranged above the second frame.

12. The image formation device according to claim 1, further comprising a sheet tray mounting the recording sheets to be fed toward the image formation unit, the sheet tray being movable in a horizontal direction that is parallel with a plane of the electric substrate and detachably attached to the image formation device.

13. The image formation device according to claim 12, further comprising:

a process unit configured to form an image on the recording sheet; and a drawer casing to which the process unit is provided, the drawer casing being movable in the horizontal direction which is parallel with a plane of the electric substrate and detachably attached to a main body.

14. The image formation device according to claim 1, further comprising another first frame, the first frame and the other first frame constituting a pair of first frames sandwiching the image formation unit.

15. An image formation device, comprising:

an image formation unit including a photoconductive drum bearing developer, a charger configured to charge the photoconductive drum;

a main frame arranged to support the image formation unit;

an electric substrate secured to the main frame, the electric substrate providing electric power to the charger;

a light emitter and a light receiver provided on the electric substrate, the light emitter emitting a light beam to a predetermined portion of the image formation unit, the light receiver receiving a light beam emitted from the image formation unit; and an optical element provided on the electric substrate and arranged on an optical axis of one of the light emitter and the light receiver.

16. The image formation device according to claim 15, wherein the photoconductive drum is one of a plurality of photoconductive drums arranged in a sheet feed direction, and wherein a plurality of light emitters including the light emitter or light receivers including the light receiver are arranged along the sheet feed direction, at positions corresponding to the plurality of photoconductive drums.

17. The image formation device according to claim 15, wherein the main frame comprises a pair of supporting frames to which the image formation unit is secured.

* * * * *